US010224657B1

(12) United States Patent
Ruffini et al.

(10) Patent No.: US 10,224,657 B1
(45) Date of Patent: Mar. 5, 2019

(54) SPRING FOR USE IN AN RF CONTACT FOR A PLUG-IN MODULE

(71) Applicant: TE CONNECTIVITY CORPORATION, Berwyn, PA (US)

(72) Inventors: Nicholas Paul Ruffini, Lancaster, PA (US); Kevin Michael Thackston, York, PA (US); Cammie L. Johanning, Fremont, CA (US); Brian Todd Klinger, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/878,728

(22) Filed: Jan. 24, 2018

(51) Int. Cl.

| | |
|---|---|
| ***H01R 13/187*** | (2006.01) |
| ***H01R 13/11*** | (2006.01) |
| ***H01R 13/646*** | (2011.01) |
| ***H01R 13/631*** | (2006.01) |

(52) U.S. Cl.
CPC ..... *H01R 13/111* (2013.01); *H01R 13/6315* (2013.01); *H01R 13/646* (2013.01)

(58) Field of Classification Search
CPC .... H01R 13/187; H01R 13/111; H01R 43/16; H01R 13/113; H01R 13/18; H01R 13/642; H01R 13/6315
See application file for complete search history.

(56) References Cited

U.S. PATENT DOCUMENTS

| | | | | |
|---|---|---|---|---|
| 4,778,404 A * | 10/1988 | Pass | H01R 13/2428 | 439/246 |
| 5,934,950 A * | 8/1999 | Yeow | H01R 13/187 | 439/852 |
| 8,690,602 B2 * | 4/2014 | Flaherty, IV | H01R 13/111 | 439/578 |

* cited by examiner

*Primary Examiner* — Xuong M Chung Trans

(57) ABSTRACT

A spring for use in an RF contact for a plug-in module including a hollow unitary cylindrical body having a longitudinal axis and a spring portion positioned between opposed first and second ends. The spring includes a first retainer near the first end, the first retainer adapted to be captured between first and second socket body portions of an RF contact, the first socket body portion, at least a segment of the second socket body portion, and the body adapted to be disposed within a receptacle module. The spring includes a second retainer near the second end, the second retainer adapted to be captured by a corresponding feature of the receptacle module. In response to the body being mounted in the receptacle module to floatingly secure the first socket body portion and the at least a segment of the second socket body portion therein, the spring portion is in tension.

20 Claims, 5 Drawing Sheets

SPRING FOR USE IN AN RF CONTACT FOR A PLUG-IN MODULE

FIELD OF THE INVENTION

The present invention is directed to RF contacts for plug-in modules and method for assembling same.

BACKGROUND OF THE INVENTION

Radio communication technology utilize radio frequency (RF) signals for applications including network systems, servers, data centers, and the like. In one construction, RF connectors include plug-in modules interconnecting in a backplane/daughtercard configuration for transmitting RF signals as outlined in American National Standards Institute/VMEbus International Trade Association (ANSI/VITA) 67 series of standards. This series of standards provide a high density, blind mating arrangement between the modules.

Conventional module constructions may utilize a spring assembly to retain floating contacts internal of the modules. Although effective, fabrication of the separate pieces of the spring assembly can be difficult.

Accordingly, there is a need for improved plug-in modules that do not suffer from these drawbacks.

SUMMARY OF THE INVENTION

An embodiment is directed to a spring for use in an RF contact for a plug-in module including a hollow unitary cylindrical body having a longitudinal axis and a spring portion positioned between a first end and an opposed second end. The spring further includes a first retainer near the first end, the first retainer adapted to be captured between a first socket body portion and a second socket body portion of an RF contact, the first socket body portion, at least a segment of the second socket body portion, and the body adapted to be disposed within a receptacle module. The spring further includes a second retainer near the second end, the second retainer adapted to be captured by a corresponding feature of the receptacle module. In response to the body being mounted in the receptacle module to floatingly secure the first socket body portion and the at least a segment of the second socket body portion therein, the spring portion is in tension.

A further embodiment is directed to a RF contact assembly including a hollow unitary cylindrical body having a longitudinal axis and a spring portion positioned between a first end and an opposed second end. The RF contact assembly further including a first socket body portion and a second socket body portion of an RF contact, and a first retainer near the first end, the first retainer captured between the first socket body portion and the second socket body portion of the RF contact, the first socket body portion, at least a segment of the second socket body portion, and the body adapted to be disposed within a receptacle module. The RF contact assembly further including a second retainer near the second end, the second retainer adapted to be captured by a corresponding feature of the receptacle module. In response to the spring being mounted in the receptacle module to floatingly secure the first socket body portion and the at least a segment of the second socket body portion therein, the spring portion is in tension.

A yet further embodiment is directed to a method of assembling an RF contact into a plug-in module including capturing a first retainer of a spring between a first socket body portion and a second socket body portion of an RF contact, and inserting the first socket body portion, at least a segment of the second socket body portion, and the spring inside a receptacle module. The method further includes capturing a second retainer of the spring in the receptacle module, thereby floatingly securing the first socket body portion and the at least a segment of the second socket body portion therein, the spring being placed in tension.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The description of illustrative embodiments according to principles of the present invention is intended to be read in connection with the accompanying drawings, which are to be considered part of the entire written description. Terms such as "attached," "affixed," "connected," "coupled," "interconnected," "engaged," "installed" and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 1:
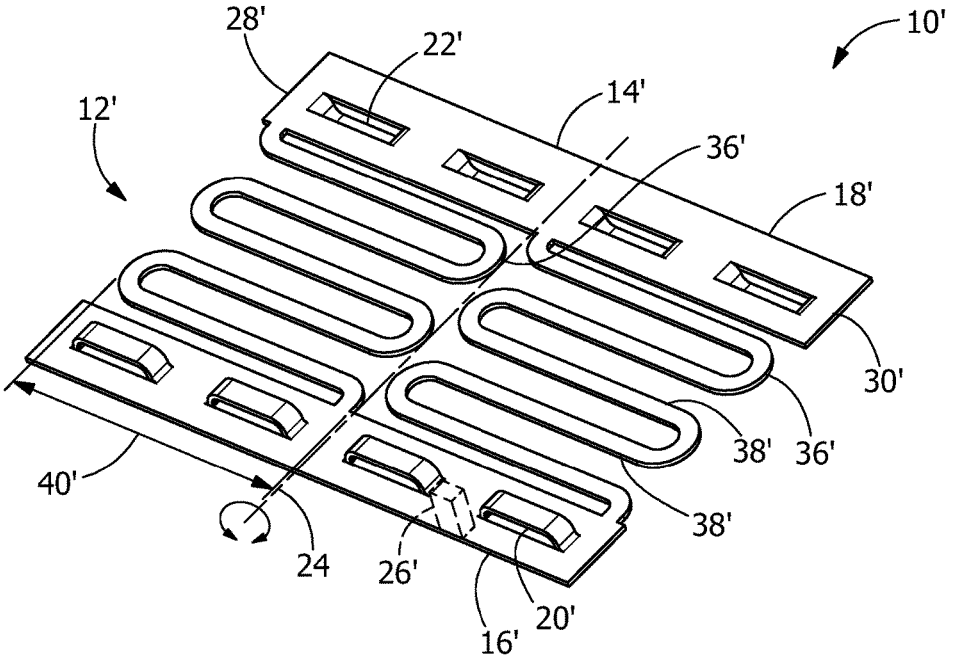
FIG. 1 is an upper perspective view of an exemplary spring blank according to the present invention.
Figure 2:
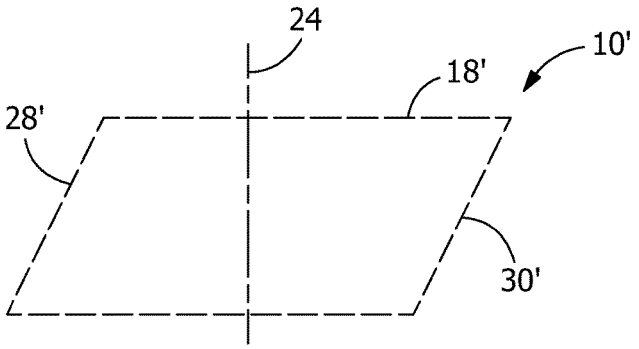
FIG. 2 is a plan view of an outline of an exemplary spring blank according to the present invention.
Figure 3:
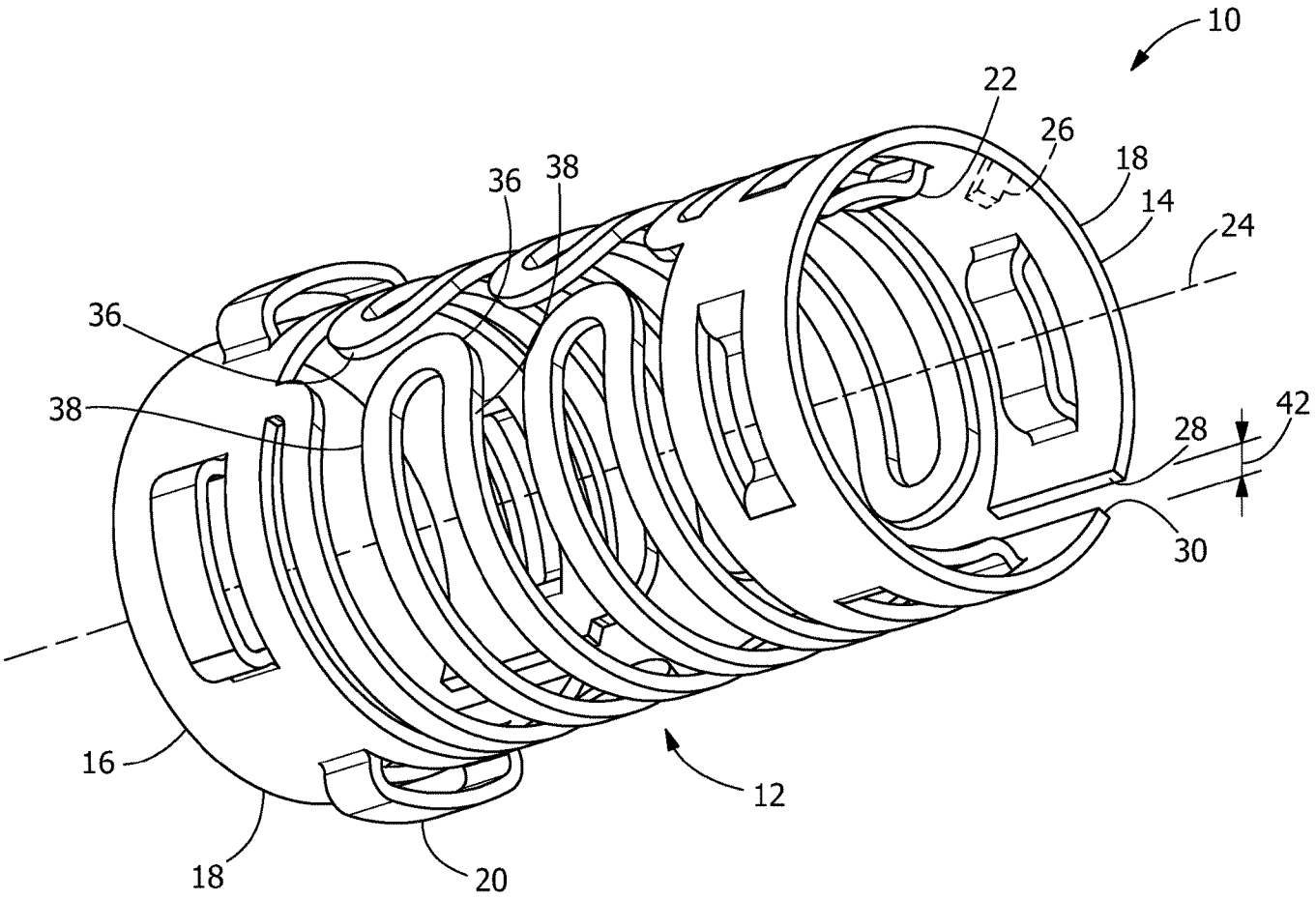
FIGS. 3-5 are different upper perspective views of the stamped spring of FIG. 1 according to the present invention.
Figure 6:
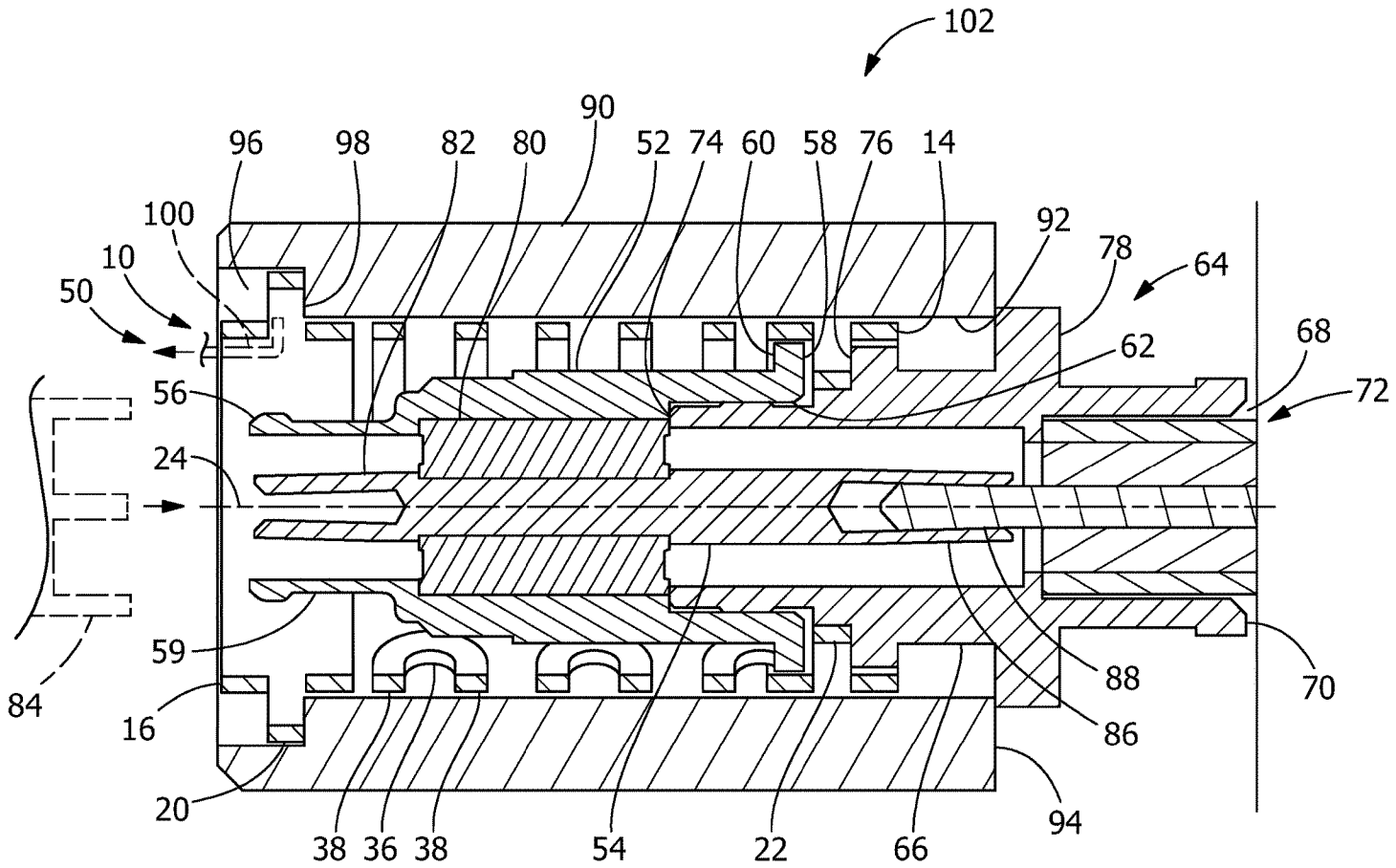
FIG. 6 is a cross section of an exemplary RF contact assembly according to the present invention.

FIG. 1 is a blank of an exemplary spring 10' that is formed from a single foil layer, which when formed (i.e., stamped and/or rolled), becomes a formed socket spring 10 (FIG. 3). This single piece construction results in simplification of the manufacturing process, parts reduction, as well as manufacturing time, resulting a cost savings, with improved reliability. Spring 10' includes a body 18' having a spring portion 12' that extends between an end 14' along an axis or longitudinal axis 24 and an opposed end 16'. In one embodiment, such as shown in FIG. 1, body 18' is a rectangle with opposed edges 28', 30' extending generally parallel to longitudinal axis 24. In one embodiment, FIG. 2, which is a plan view, the outline of body 18' is a parallelogram, with edges 28', 30' positioned non-parallel to longitudinal axis 24. One or more retainers 20' near end 16' (four are shown in FIG. 1) extend or protrude away from the surface of body 18' in one sense, and one or more retainers 22' (four are shown in FIG. 1) near end 14' extend or protrude away from the surface of body 18' in an opposite sense. As shown in FIG. 1, retainers 20', 22' each comprise a strip of material resembling a C-shape. In one embodiment, one or more of the retainers may be a cantilevered beam 26' such as shown at end 16' or other suitable construction providing an engagement surface with module socket housing 90 (FIG. 6).

As further shown in FIG. 1, spring portion 12' includes a pair of beams 36', with each beam comprising a plurality of beam portions 38'. In one embodiment, the number of beams is different than two. As shown, beam portions 38' loopingly extend generally perpendicular to longitudinal axis 24. That is, adjacent beam portions 38' form or resemble a loop, i.e., overlapping one another or folding or being doubled upon one another in a direction generally perpendicular to the longitudinal axis so as to leave an opening therebetween. As a result of application of opposed forces applied parallel to longitudinal axis 24 to retainers 20', 22', spring 10' is stretched, i.e., the distance between adjacent loops defined by adjacent beam portions 38' increases, and the distance between opposed ends 14', 16' is increased. As further shown in FIG. 4, each beam 38 defines or extends along a partial periphery 40 of body 18 (FIG. 1, partial periphery 40' of body 18' for clarity) that does not overlap one other. In one embodiment, the partial peripheries defined by a corresponding beam portions 38 are uniform in length. In one embodiment, at least portions of the partial peripheries of corresponding beam portions 38 are not uniform in length relative to one another. In one embodiment, the partial peripheries may at least partially overlap one another.

Figure 4:
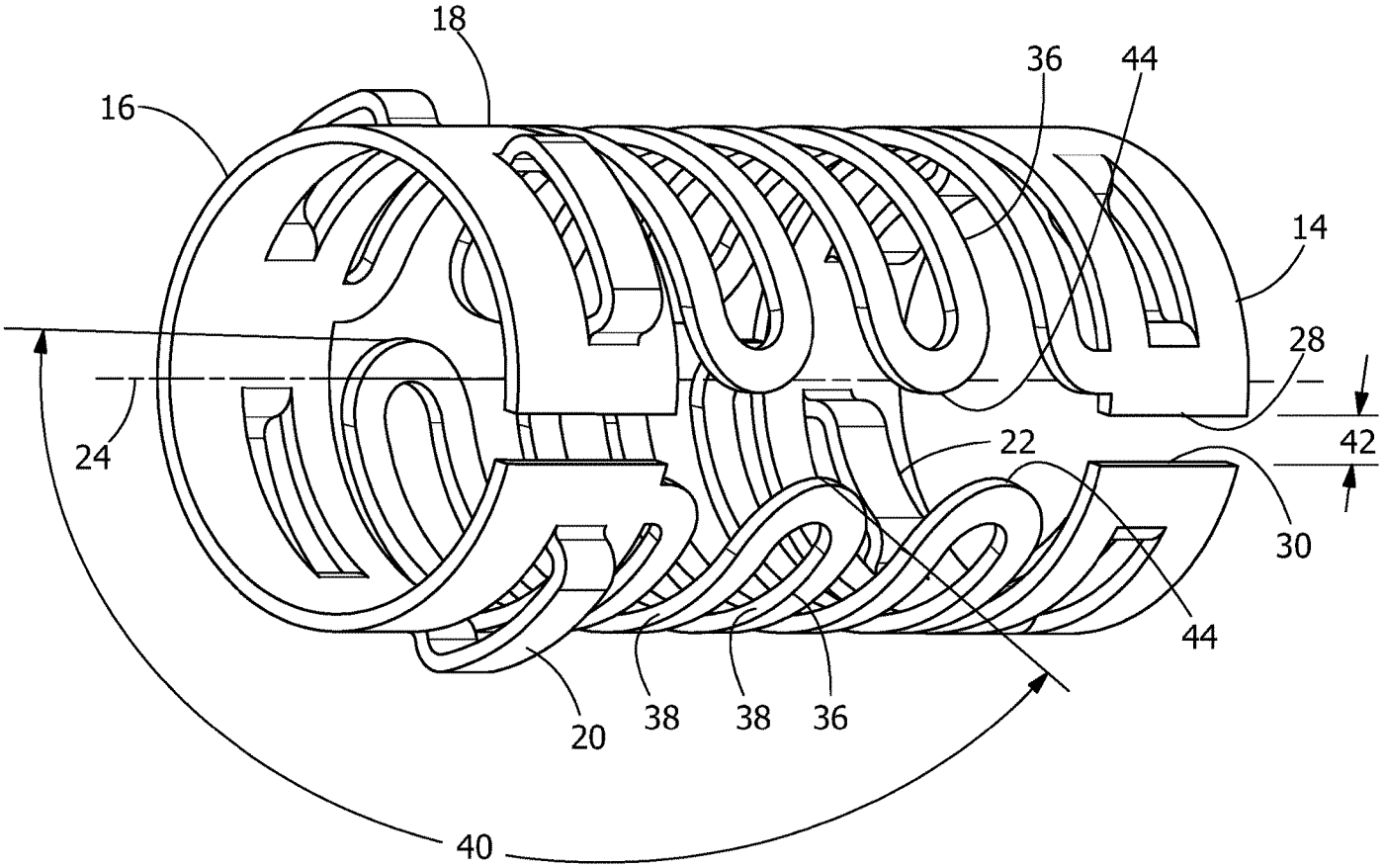
Figure 5:
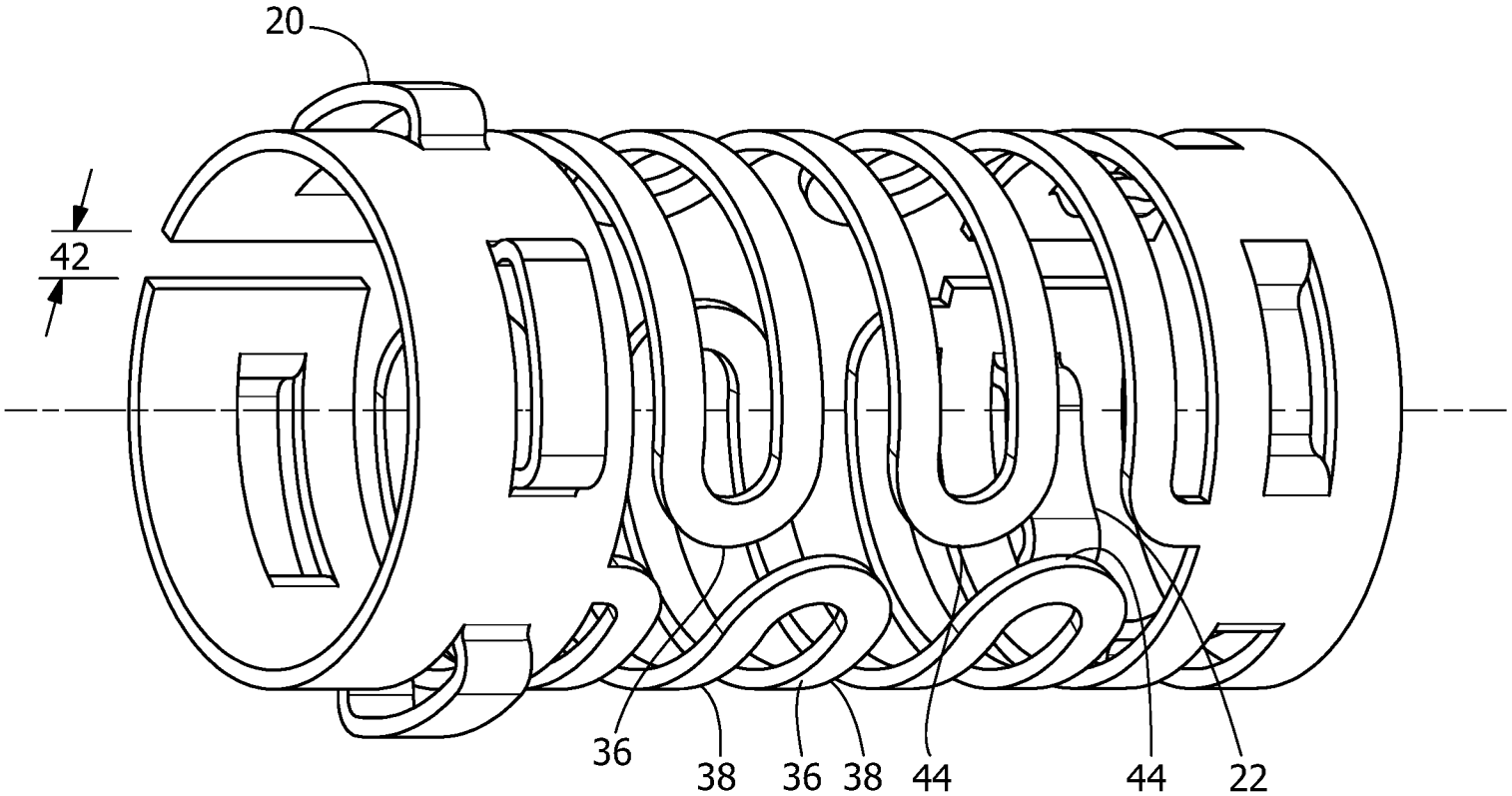

Components of blank of spring 10' of FIG. 1 correspond to formed spring 10 of FIGS. 3-5. That is, spring 10 includes a hollow cylindrical body 18 having a spring portion 12 that extends between an end 14 along a longitudinal axis 24 and an opposed end 16. In one embodiment, such as shown in FIG. 1, body 18' is a rectangle with opposed edges 28', 30' extending generally parallel to longitudinal axis 24. In one embodiment, FIG. 2, which is a plan view, the outline of body 18' is a parallelogram, with edges 28', 30' positioned nonparallel to longitudinal axis 24, which would result, upon forming the spring about longitudinal axis 24, edges 28, 30 similarly extending nonparallel to the axis. A continuous spacing 42 separates edges 28, 30 along the length of spring 10. As shown in FIGS. 3-5, spacing 42 between edges 28, 30 are generally uniform. In one embodiment, spacing 42 between edges 28, 30 extends parallel and linearly to longitudinal axis 24. In one embodiment, at least a portion of the spacing 42 between edges 28, 30 extends non-linearly relative to longitudinal axis 24. In one embodiment, the spacing between edges 28, 30 may vary along the length of the spring. In one embodiment, the spacing between edges 28, 30 and between corresponding ends 44 of beams 36 is continuous and generally uniform between opposed ends 14, 16. In one embodiment, the spacing between the edges and the corresponding ends of the beams may be the same. One or more retainers 20 near end 16 (four are shown in FIGS. 3-5) extend or protrude away from the surface of body 18 in one sense, and one or more retainers 22 (four are shown in FIG. 1) near end 14 extend or protrude away from the surface of body 18 in an opposite sense. That is, for spring 10, retainers 20 extend outwardly from the outer surface of body 18 and retainers 22 extend inwardly from the inner surface of body 18. As shown in FIG. 1, retainers 20, 22 each comprise a strip of material resembling a C-shape. In one embodiment, one or more of the retainers may be a cantilevered beam 26 (FIG. 3) such as shown at end 16 or other suitable construction providing an engagement surface with module socket housing 90 (FIG. 6). In response to a sufficient compressive force applied to body 18, spacing the two between edges 28, 30 is decreased, resulting in a decrease in the periphery and cross-section of the body, permitting insertion of both end 16 and outwardly extending retainers 20 and an opening being smaller in size or having a smaller cross section than the body in an uncompressed state.

As further shown in FIG. 3, spring portion 12 includes a pair of beams 36, with each beam comprising a plurality of beam portions 38. In one embodiment, the number of beams is different than two. As shown, beam portions 38 loopingly extend generally perpendicular to longitudinal axis 24. That is, adjacent beam portions 38 form or resemble a loop, i.e., overlapping one another or folding or being doubled upon one another so as to leave an opening therebetween. As a result of application of opposed forces applied parallel to longitudinal axis 24 to retainers 20, 22, spring 10 is stretched, i.e., the distance between adjacent loops defined by adjacent beam portions 38 increases, and the distance between opposed ends 14, 16 is increased. As further shown in FIG. 4, beam portions 38 of each beam 36 define or extend along a partial periphery 40 of body 18 that do not overlap one other. In one embodiment, the partial peripheries defined by a corresponding beam portions 38 are uniform in length. In one embodiment, at least portions of the partial peripheries of corresponding beam portions 38 are not uniform in length relative to one another. In one embodiment, the partial peripheries may at least partially overlap one another. In one embodiment, such as shown in FIG. 4, ends 44 of opposed beam portions 38 may be alternately arranged relative to one another along a longitudinal axis 24.

Referring now to FIG. 6, operation of the novel spring for use in an RF contact is now discussed. As shown, RF contact 50, which is a socket, includes a socket body portion 52 insulatively surrounding and secured via insulator 80 to a base socket 54. Socket body portion 52 includes fingers or tines 59 extending generally parallel to axis 24, terminating at an end 56, and an opposite end 58 having an opening 62 for receiving socket body portion 66, with end 58 further having a radially outwardly extending annular flange 60. Base socket 54 includes tines 82 extending parallel to axis 24 and corresponding to tines 59 at end 56 of socket body portion 52, which tines 59, 82 being adapted for receiving a receptacle 84. Opposite end 56, base socket 54 extends parallel to axis 24 to tines 86 for receiving a conductor 88 of coax cable 72.

As further shown in FIG. 6, an RF contact assembly 64 includes a socket body portion 66 having an opening 68 formed in an end 70 for receiving a coax cable 72. Socket body portion 66 further includes an opposed end 74, and radially outwardly extending annular flanges 76, 78 positioned between ends 70, 74. Once coax cable 72 is been received in opening 68 of socket body portion 66, end 74 of socket body portion 66 is directed inside of spring 10 until retainers 22 are brought into contact with or abut annular flange 76. Subsequently, tines 86 of base socket 54 which is secured to socket body portion 52 is inserted inside of end 16 of spring 10 until tines 86 receive conductor 88 of coax cable 72 and annular flange 60 of socket body portion 52 and annular flange 76 of socket body portion 66 capture retainer 22 of the spring. Once retainer 22 of spring 10 has been captured by socket body portions 52, 66, end 16 of the spring is inserted inside an opening 92 formed in an end 94 of a socket housing 90 of a receptacle module 102. In order for retainer 20 of spring 10 to fit inside of opening 92, a compressive force perpendicular to axis 24 is applied to the spring as previously discussed. Once retainer 20 has been inserted inside of opening 92, retainer 20 is further inserted along axis 24 until annular flange 78 of socket body portion 66 abuts end 94, while at least a portion or segment of socket body portion 66 is partially inserted or adapted to be disposed inside of or within socket housing 90. Socket housing 90 includes an annular recess 96 having a shoulder 98 that is sufficiently spaced away from end 94 such that upon full insertion of the spring and socket body portion 52, and partial insertion of socket body portion 66 inside of opening 92 of socket housing 90, retainer 20 of spring 10 uncompressed in the direction parallel to axis 24. A tool 100 engages spring 10 near end 16, and upon application of sufficient force along axis 24 away from end 94 of socket housing 90, the spring is placed in tension or stretched such that retainer 20 slides over shoulder 98, at which time retainers 20 expand radially outward by virtue of a retaining force of the spring, capturing the spring, resulting in the spring being mounted in the receptacle module 102. In order to permit disassembly of the RF contact from the receptacle module, the spring must be sufficiently compressed in a direction perpendicular to axis 24 such that retainers 20 are no longer captured by shoulder 98, after which the spring can be moved parallel to axis 24 away from shoulder 98 until the spring is removed from opening 92 of socket housing 90.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A spring for use in an RF contact for a plug-in module comprising:

a hollow unitary cylindrical body having a longitudinal axis and a spring portion positioned between a first end and an opposed second end;

a first retainer near the first end, the first retainer adapted to be captured between a first socket body portion and a second socket body portion of an RF contact, the first socket body portion, at least a segment of the second socket body portion, and the body adapted to be disposed within a receptacle module; and a second retainer near the second end, the second retainer adapted to be captured by a corresponding feature of the receptacle module;

wherein in response to the body being mounted in the receptacle module to floatingly secure the first socket body portion and the at least a segment of the second socket body portion therein, the spring portion is in tension.

2. The spring of claim 1, wherein the first retainer extends inwardly from the body.

3. The spring of claim 1, wherein the second retainer extends outwardly from the body.

4. The spring of claim 1, wherein at least one of the first retainer and the second retainer resembles a loop.

5. The spring of claim 1, wherein at least one of the first retainer and the second retainer is a cantilevered beam.

6. The spring of claim 1, wherein the body having a continuous spacing extending from the first end to the second end.

7. The spring of claim 6, wherein the spacing extends parallel to the axis.

8. The spring of claim 6, wherein the spacing extends at least partially nonparallel to the axis.

9. The spring of claim 6, wherein at least a portion of the spacing extends non-linearly.

10. The spring of claim 1, wherein the spring portion includes a pair of beams, each beam having a plurality of beam portions loopingly extending generally perpendicular to the axis in a first direction.

11. The spring of claim 10, wherein one beam of the pair of beams comprises a plurality of beam portions loopingly extending along a first partial periphery of the body, and the other beam of the pair of beams comprises a plurality of beam portions loopingly extending along a second partial periphery of the body.

12. The spring of claim 11, wherein the loopingly extending beam portions extending along the first partial periphery are alternately arranged along the axis relative to corresponding loopingly extending beam portions extending along the second partial periphery.

13. The spring of claim 12, wherein the first partial periphery and the second partial periphery do not overlap each other.

14. An RF contact assembly comprising:

a hollow unitary cylindrical body having a longitudinal axis and a spring portion positioned between a first end and an opposed second end;

a first socket body portion and a second socket body portion of an RF contact;

a first retainer near the first end, the first retainer captured between the first socket body portion and the second socket body portion of the RF contact, the first socket body portion, at least a segment of the second socket body portion, and the body adapted to be disposed within a receptacle module; and a second retainer near the second end, the second retainer adapted to be captured by a corresponding feature of the receptacle module;

wherein in response to the spring being mounted in the receptacle module to floatingly secure the first socket body portion and the at least a segment of the second socket body portion therein, the spring portion is in tension.

15. The spring of claim 14, wherein the first retainer extends inwardly from the body.

16. The spring of claim 14, wherein the second retainer extends outwardly from the body.

17. The spring of claim 14, wherein the body having a continuous spacing extending from the first end to the second end.

18. The spring of claim 14, wherein the spring portion includes a pair of beams, each beam having a plurality of beam portions loopingly extending generally perpendicular to the axis in a first direction.

19. The spring of claim 18, wherein one beam of the pair of beams comprises a plurality of beam portions loopingly extending along a first partial periphery of the body, and the other beam of the pair of beams comprises a plurality of beam portions loopingly extending along a second partial periphery of the body.

20. A method of assembling an RF contact into a plug-in module comprising:

capturing a first retainer of a spring between a first socket body portion and a second socket body portion of an RF contact;

inserting the first socket body portion, at least a segment of the second socket body portion, and the spring inside a receptacle module;

capturing a second retainer of the spring in the receptacle module, thereby floatingly securing the first socket body portion and the at least a segment of the second socket body portion therein, the spring being placed in tension.

* * * * *